US005378111A

United States Patent [19]

Christopher

[11] Patent Number: 5,378,111

[45] Date of Patent: Jan. 3, 1995

[54] MOTOR VEHICLE FUEL PUMP ASSEMBLY WITH PRESSURE RELIEF ORIFICE

[75] Inventor: Brian J. Christopher, Clio, Mich.

[73] Assignee: General Motors Corporation, Detroit, Mich.

[21] Appl. No.: 80,248

[22] Filed: Jun. 21, 1993

[51] Int. Cl.[6] ..... F04B 23/14

[52] U.S. Cl. ..... 417/203; 418/189; 418/225

[58] Field of Search ..... 417/201, 203, 205; 418/189, 225

[56] References Cited

U.S. PATENT DOCUMENTS

| | | | |
|---|---|---|---|
| 2,670,688 | 3/1954 | Graham | 418/189 |
| 3,947,149 | 3/1976 | MacManus . | |
| 4,181,473 | 1/1980 | Ina . | |
| 4,207,038 | 6/1980 | Strikis | 418/189 |
| 4,259,044 | 3/1981 | Drutchas et al. . | |
| 4,295,797 | 10/1981 | Ruhl et al. | 417/203 |
| 4,336,002 | 6/1982 | Rose et al. | 417/203 |
| 4,456,436 | 6/1984 | Schillinger et al. | 418/225 |
| 4,484,863 | 11/1984 | Pagel . | |
| 4,596,521 | 6/1986 | Murayama et al. | 418/189 |
| 4,636,153 | 1/1987 | Ishizuka et al. . | |
| 4,718,827 | 1/1988 | Sutton et al. | 417/244 |
| 4,867,658 | 9/1989 | Sugita et al. . | |
| 5,024,578 | 6/1991 | Vansadia . | |

FOREIGN PATENT DOCUMENTS

| | | | |
|---|---|---|---|
| 3426399 | 1/1986 | Germany | 418/225 |
| 280887 | 11/1988 | Japan | 418/189 |
| 241996 | 9/1990 | Japan | 418/189 |
| 1275915 | 6/1972 | United Kingdom | 418/225 |

*Primary Examiner*—Richard A. Bentsch
*Assistant Examiner*—Roland G. McAndrews, Jr.
*Attorney, Agent, or Firm*—Saul Schwartz

[57] ABSTRACT

A fuel pump-suited for a Demand System motor vehicle fuel injection system includes a lower pressure vapor separating pump stage, a roller vane positive displacement high pressure pump stage, and a variable speed electric motor for driving an impeller in the vapor separating stage and a rotor in the roller vane stage. The roller vane stage has a bleed orifice therein located on an inlet side plate of the roller vane stage to intercept succeeding ones of a plurality of vane pockets on the rotor between a downstream end of a discharge port of the roller vane stage and an upstream end of an inlet port of the roller vane stage when the vane pockets are isolated from both ports. The bleed orifice is in flow communication with a fuel tank of the vehicle and functions to relieve the pressure of fuel trapped in the roller pockets upstream of the inlet port and to recirculate an increasing fraction of the discharge of the roller vane stage back to the fuel tank which fraction as the speed of the electric motor decreases to a minimum.

5 Claims, 2 Drawing Sheets

MOTOR VEHICLE FUEL PUMP ASSEMBLY WITH PRESSURE RELIEF ORIFICE

FIELD OF THE INVENTION

This invention relates to electric fuel pump assemblies for motor vehicles.

BACKGROUND OF THE INVENTION

Common motor vehicle fuel injection systems include an in-tank fuel pump assembly with an electric motor driven high pressure pump stage, a high pressure fuel rail, and a low pressure return pipe for returning surplus fuel from the fuel rail to the tank. Typically, the high pressure pump stage is a roller vane positive displacement pump. Recently, attention has been focused on motor vehicle fuel injection systems, referred to as "Demand Systems", in which the discharge of the high pressure pump stage is controlled to match engine demand by modulating the speed of the electric motor. Demand Systems are attractive because they do not require apparatus for returning surplus fuel to the fuel tank and because they do not require apparatus in the tank for segregating surplus fuel, which is usually hot, from bulk fuel, which is usually relatively cool. A roller vane high pressure pump stage according to this invention is particularly suited for application in electric fuel pump assemblies in Demand Systems.

SUMMARY OF THE INVENTION

This invention is a new and improved electric fuel pump assembly for a Demand System motor vehicle fuel injection system including a variable speed electric motor, a low pressure vapor separating pump stage, and a roller vane positive displacement high pressure pump stage. The roller vane pump stage includes an inlet side plate having an arc-shaped inlet port therein, a discharge side plate having an arc-shaped discharge port therein, a cam ring between the side plates, and a rotor between the side plates having outward opening roller pockets and a plurality of rollers in the pockets engageable on a cam edge of the cam ring. In conventional roller vane pump fashion, the cam edge has inlet and discharge ramps in register with the inlet and discharge ports, which effect radial reciprocation of the rollers in the their respective roller pockets as the rotor rotates, and a generally constant radius intermediate ramp between the downstream end of the discharge ramp and the upstream end of the inlet ramp. The inlet side plate has a bleed orifice therein at a radial distance from the axis of rotation of the rotor calculated to intercept the roller pockets near their closed ends and within the angular interval subtended by the intermediate ramp at a location in which a roller pocket in flow communication with the bleed orifice overlaps neither the discharge ramp nor the inlet ramp. Outside the roller vane pump stage, the bleed orifice is in flow communication with the fuel tank through the low pressure pump stage so that fuel trapped or captured at high pressure in the roller pockets in the angular interval subtended by the intermediate ramp exhausts through the bleed orifice to the fuel tank before exposure to low pressure prevailing at the upstream end of the inlet ramp.

DESCRIPTION OF A PREFERRED EMBODIMENT

Figure 1:
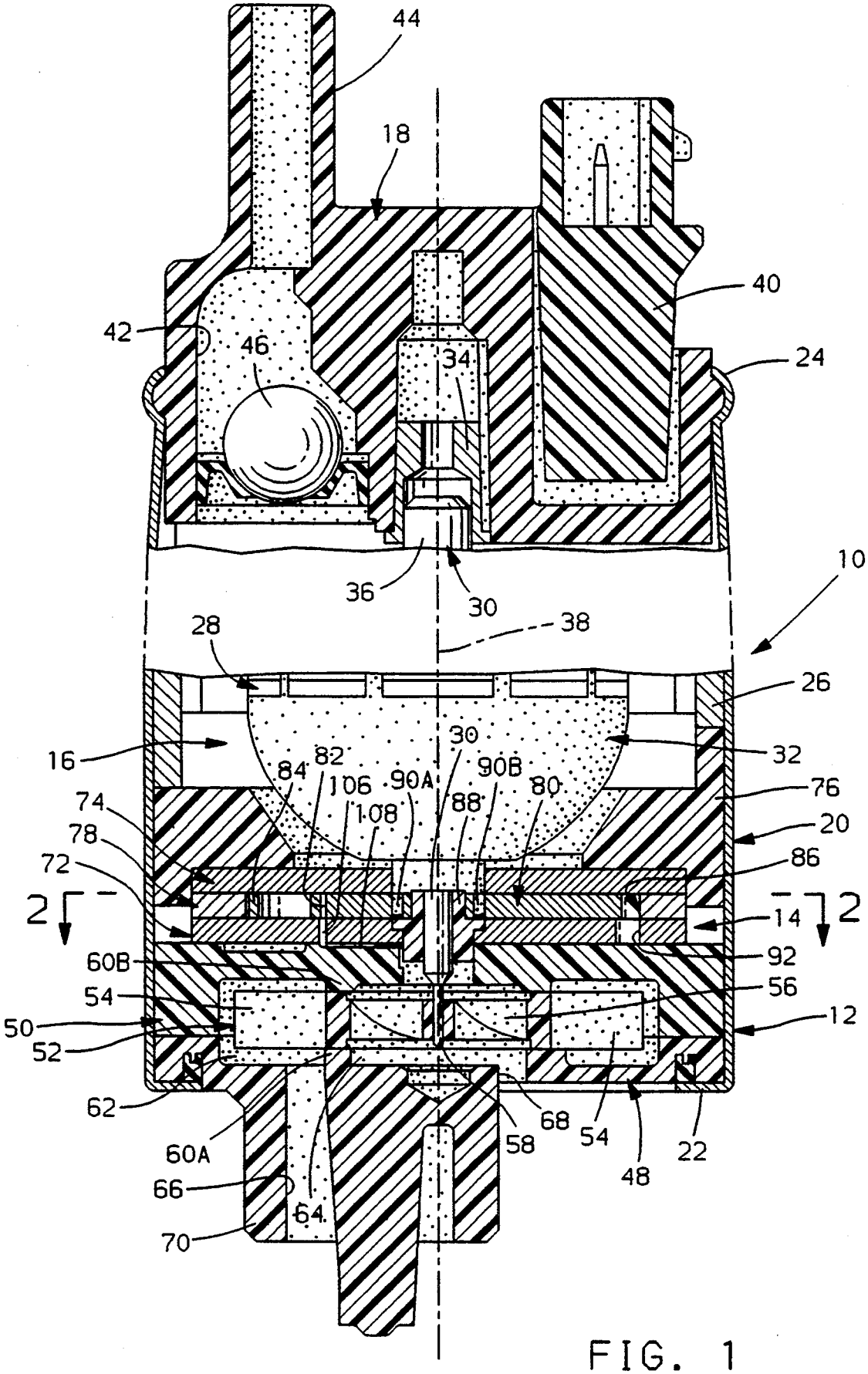
FIG. 1 is a fragmentary partially broken-away view of an electric fuel pump assembly particularly suited for Demand Systems and including a roller vane pump stage according to this invention.
Figure 2:
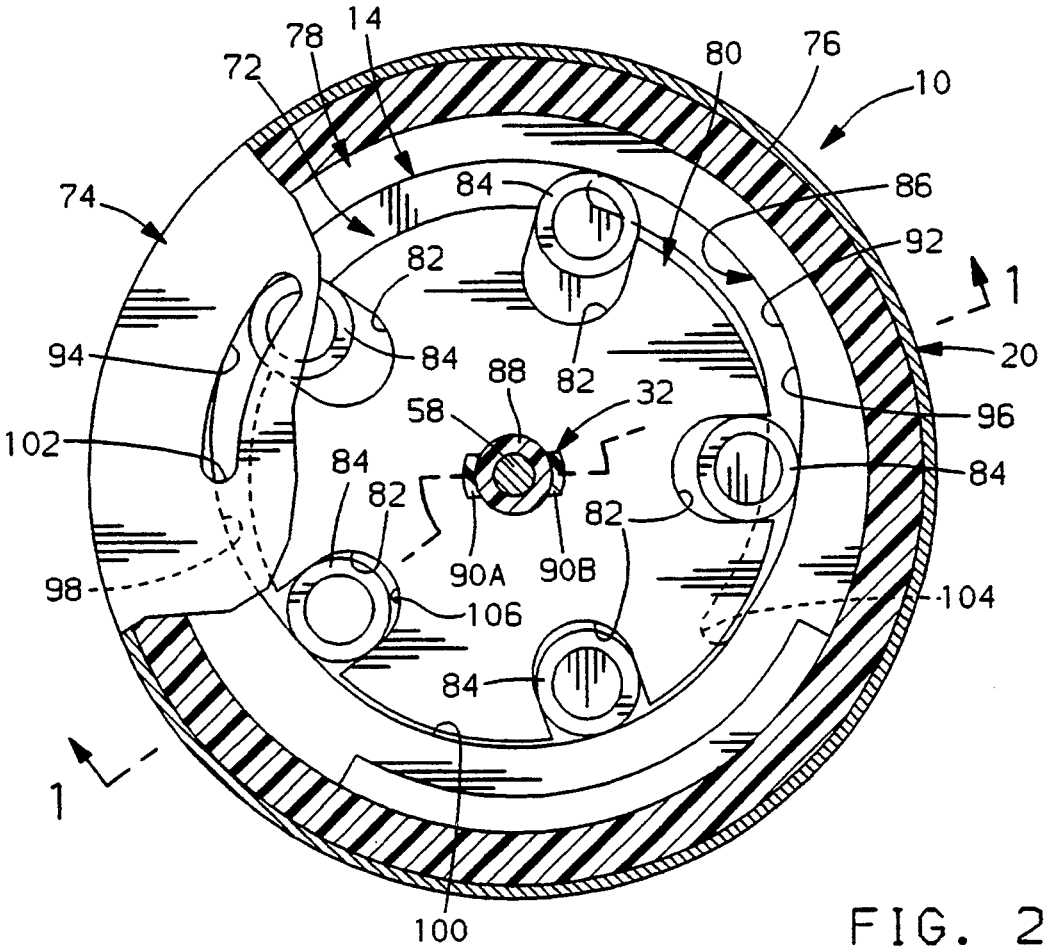
FIG. 2 is a sectional view taken generally along the plane indicated by lines 2—2 in FIG. 1.

Referring to FIGS. 1 and 2, an electric fuel pump assembly 10, particularly suited for application in a Demand System motor vehicle fuel injection system and generally as described in U.S. Pat. No. 4,718,827, issued Jan. 12, 1988 and assigned to the assignee of this invention, is mounted in a fuel tank, not shown, of the vehicle for operation submerged in fuel. The pump assembly 10 includes a low pressure vapor separating pump stage 12, a high pressure roller vane positive displacement pump stage 14 according to this invention, a variable speed electric motor 16, and a discharge end housing 18. The pump stages 12,14, the motor 16, and end housing 18 are stacked in a tubular shell 20 and captured between a lip 22 on the shell and an end 24 of the shell rolled over a shoulder on the end housing 18.

The electric motor 16 includes a tubular flux ring 26 closely received in the shell 20, field magnets, not shown, mounted on the flux ring, and an armature 28. The armature 28 includes a shaft 30, a field winding, not shown, and a plastic driver 32 molded on the shaft 30. A bearing 34 supports a first end 36 of the shaft 30 on the end housing 18 for rotation about the centerline 38. Commutator brushes, not shown, on the end housing bear against a commutator, not shown, on the armature and are connected to electrical terminals on a terminal block 40 on the end housing.

A passage 42 in the end housing 18 defines a high pressure discharge of the pump assembly 10 through which fuel is conducted from inside the shell 20 to a hose, not shown, attached to a boss 44 on the end housing around the passage. A check valve 46 on the end housing prevents backflow into the pump assembly. A wiring harness, not shown, of the vehicle is connected to the terminals on the terminal block 40 on the end housing. In the Demand System for which the pump assembly 10 is particularly suited, the wiring harness is connected to an electronic control on the vehicle which, through modulation of armature field current, varies the speed of the armature 28 in proportion to engine demand, i.e. maximum armature speed at maximum engine demand and minimum armature speed at engine idle.

The vapor separating pump stage 12, described generally in the aforesaid U.S. Pat. No. 4,718,827, has a two-piece housing including a first housing segment 48 abutting the lip 22 on the shell and a second housing segment 50 abutting the first segment. A disc-shaped impeller chamber is defined between the housing segments 48,50. An open vane regenerative turbine pump impeller 52 is disposed in the impeller chamber and has a plurality of paddle-like radial vanes 54 around its periphery and a plurality of radial spokes 56 defining a fan in the center of the impeller. The impeller 52 is drivingly connected to a second end 58 of the armature shaft 30 for rotation as a unit with the armature 28 about the centerline 38.

A pair of annular lands 60A–B on the housing segments 48,50, respectively, have a close running fit with corresponding sides of the impeller 52 and separate an annular regenerative turbine pump chamber 62 defined around the vanes 54 from a vapor chamber 64 in the center of the impeller around the spokes 56. The housing segment 48 has an inlet port 66 for admitting fuel from the fuel tank to the pump chamber 62, a discharge port, not shown, for discharging fuel from the pump chamber, a vapor discharge port 68 for exhausting vapor from the vapor chamber 64 to the fuel tank, and an annular boss 70 around the inlet port 66 separating the latter from the vapor discharge port 68. The boss 70 prevents direct recirculation of vapor and defines a convenient location for attaching a filtering screen, not shown. A check valve, not shown, may be disposed in the vapor discharge port 68 to prevent backflow of fuel from the tank into the vapor chamber 64.

The roller vane pump stage 14 according to this invention includes a disc-shaped first or inlet side plate 72 abutting the housing segment 50 of the vapor separating pump stage, a disc-shaped second or discharge side plate 74 seated in a plastic housing 76, a cam ring 78 between the side plates, and a rotor 80 inside the cam ring between the side plates. The side plates 72,74, parallel and disposed in planes perpendicular to the centerline 38, and the ring 78 are riveted or otherwise rigidly joined. For torque reaction, the plastic housing 76 and the pump stages 12,14 are all non-rotatably joined to the flux ring 26 of the electric motor.

Figure 3:
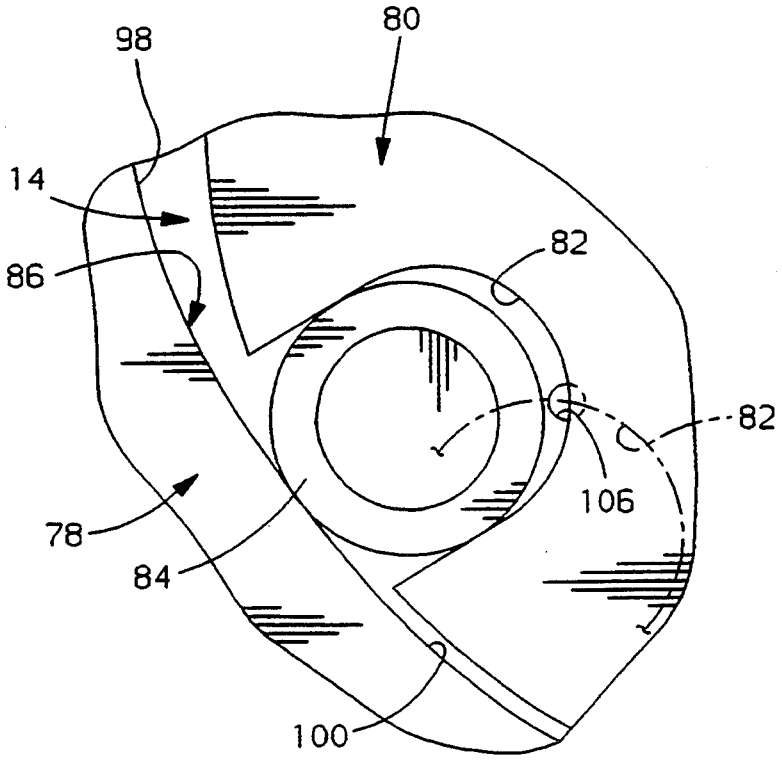
FIG. 3 is an enlarge view of a portion of FIG. 2.

The rotor has a plurality of evenly circumferentially spaced U-shaped roller pockets 82 therein opening outward toward the cam ring 78. A hollow, ring-shaped roller 84 is loosely received in each roller pocket 82 for engagement on a cam edge 86 of the cam ring 78 and for radial reciprocation in conventional roller vane pump fashion. A bearing insert 88 on the inlet side plate 72 supports the end 58 of the armature shaft on the side plate and on the shell 20 for rotation about the centerline 38. A pair of forks 90A–B, FIGS. 1 and 2, on the plastic driver 32 on the armature 28 are received in a corresponding pair of apertures in the rotor 80 whereby the armature drives the rotor counterclockwise, FIGS. 2–3, as a unit with the impeller 52 in the vapor separating pump stage 12.

As seen best in FIGS. 1 and 2, the inlet side plate 72 of the roller vane pump stage has an arc-shaped inlet port 92 therein and the discharge side plate 74 has an arc-shaped discharge port 94 therein. The inlet port 92 is in flow communication with the discharge port, not shown, of the vapor separation pump stage 12. The discharge port 94 is in flow communication across the electric motor 16 with the passage 42 in the end housing 18.

The cam edge 86 facing the rotor 80 includes an inlet ramp 96 substantially in the angular interval subtended by the inlet port 92, a discharge ramp 98 substantially in the angular interval subtended by the discharge port 94, and an intermediate ramp 100 substantially in the angular interval subtended between a downstream end 102 of the discharge port 94 and an upstream end 104 of the inlet port 92. The radial separation between the inlet ramp and the centerline 38 increases from the upstream end 104 of the inlet port to the downstream end. The radial separation between the discharge ramp and the centerline 38 decreases from the upstream end of the discharge port to the downstream end 102 thereof. The radial separation between the intermediate ramp 100 and the centerline 38 is substantially constant except for small overlaps by the downstream and upstream ends, respectively, of the discharge and inlet ramps.

The inlet side plate 72 has a bleed orifice 106 therein the size of which, i.e. area in the plane of the inlet side plate, is small compared to the width of the roller pockets 82. For example, in an application where the diameter of the rotor 80 is about 0.934 in. and a width dimension W, FIG. 3, of the roller pockets W is about 0.225 in., an area of 0.001 ($in^2$) was observed to afford the advantages described below. Outside of the roller vane pump stage 14, the bleed orifice 106 is in flow communication with a low pressure receiver defined by with the fuel tank through a notch 108 in the housing segment 50 of the vapor separation pump stage 12, around the bearing insert 88, and through the vapor chamber 64 and the vapor discharge port 68.

Radially, i.e. relative to the centerline 38, the bleed orifice 106 is located on the inlet side plate 72 to intercept successive roller pockets 82 generally near their closed ends, preferably in the portions of the roller pockets defined by the radius of curvature of the closed ends. Circumferentially, i.e. relative to the extremities of the angular interval subtended by the intermediate ramp 100, the bleed orifice 106 is located to achieve flow communication with succeeding roller pockets only in a segment of that angular interval the defining characteristic of which is concurrent isolation of the roller pockets from both the inlet and the discharge ports 92,94, respectively. Preferably, the bleed orifice is located in the aforesaid segment of the angular interval nearer to the discharge port 94 than to the inlet port 92.

When the electric motor 16 is on, the armature shaft 30 drives the impeller 52 and the rotor 80 at the speed of the armature 28 dictated by the aforesaid electronic control on the motor vehicle. Fuel from the tank enters the pump chamber 62 through the inlet port 66 and is pumped in regenerative pump fashion to the discharge port, not shown. Vapor in the fuel migrates inward between the impeller and the annular lands 60A–B into the vapor chamber 64 from which it is exhausted to the fuel tank through the vapor discharge port 68.

Fuel from the vapor separation pump stage 12 enters the expanding spaces between the rollers 84 through the inlet port 92 of the roller vane pump stage. The spaces between the rollers expand as succeeding rollers 84 traverse the inlet ramp 96 of the cam edge 86 and undergo the outward half of a full out-and-in reciprocation stroke. In the angular interval subtended by the discharge ramp, fuel between the rollers 84 is forced at high pressure out of the roller vane pump stage through the discharge port 94 as the spaces between the rollers collapse concurrently with the rollers 84 undergoing the inward half of the out-and-in reciprocation stroke.

Each roller pocket 82 is completely filled with fuel trapped at the high pressure prevailing at the discharge port 94 as the pockets cross the boundary between the angular interval subtended by the discharge ramp 98 and the angular interval subtended by the intermediate ramp 100. As soon as the bleed orifice 106 achieves flow communication with each pressurized roller pocket 82, enough fuel discharges therefrom through the bleed orifice to reduce the pressure in the roller pocket to about the lower pressure prevailing in the vapor chamber 64 of the vapor separation pump stage 12. Fuel and/or vapor formed at the bleed orifice 106 flows through the notch 108 and around the bearing insert 88 into the vapor chamber 64 from which it is exhausted to the fuel tank through the vapor discharge port 68. By reducing the pressure of the fuel trapped in the roller pockets 82, the propensity of such fuel to flash to vapor at the upstream end 104 of the inlet port 92 and interfere with fluid inflow is minimized.

For Demand System applications, the bleed orifice 106 affords the roller vane pump stage 14 an additional advantage relative to similar pump stages without the bleed orifice. For example, at minimum rotor speed corresponding to engine idle, the roller vane pump stage 14 may experience a flow condition similar to blocked discharged. In that circumstance, erratic flow patterns within the roller vane pump stage may induce noise. In the roller vane pump stage 14 with bleed orifice 106, however, a variable flow recirculation flow path between the roller vane pump stage and the fuel tank is defined through the bleed orifice which alleviates the blocked discharge condition.

It has been observed that fluid outflow from the bleed orifice 106 increases at low rotor speed corresponding to engine idle relative to outflow through the bleed orifice at higher rotor speeds. The high outflow at engine idle, believed to be attributable to the increase in duration of exposure of the bleed orifice to succeeding ones of the roller pockets as rotor speed decreases, represents an internal recirculation flow within the fuel pump assembly whereby the aforesaid excess discharge is recirculated to the fuel tank. Accordingly, flow patterns within the roller vane pump stage 14 at low rotor speed remain consistent with flow patterns at higher rotor speeds even though the flow rate from the fuel pump assembly 10 to the engine through the passage 42 is low and would otherwise induce the aforesaid erratic internal flow patterns.

The embodiments of the invention in which an exclusive property or privilege is claimed are defined as follows:

1. In a motor vehicle fuel pump assembly having a tubular shell, an electric motor in said tubular shell including an armature shaft supported on said shell for rotation about a centerline of said shell at speeds varying between a minimum corresponding to a minimum fuel demand and a maximum corresponding to a maximum fuel demand, and a roller vane pump stage including an inlet side plate in said shell in a plane perpendicular to said centerline having an arc-shaped inlet port therein whereat an inlet fluid pressure of said roller vane stage prevails, a discharge side plate in said shell in a plane perpendicular to said centerline having an arc-shaped discharge port therein whereat a discharge fluid pressure of said roller vane pump stage prevails, a rotor between said inlet and said discharge side plates connected to said armature shaft for rotation as a unit therewith and having a plurality of outward opening circumferentially spaced roller pockets therein, a plurality of rollers each disposed in a respective one of said roller pockets, and a cam ring between said inlet and said discharge side plates having a cam edge facing said rotor with an inlet ramp in a first angular interval subtended by said inlet port and a discharge ramp in a second angular interval subtended by said discharge port and an intermediate ramp in a third angular interval subtended between a downstream end of said discharge port and an upstream end of said inlet port, rotation of said rotor being operative to move each of said pockets successively through said third angular interval in a direction from said second angular interval toward said first angular interval so that a fluid pressure prevailing in each of said successive pockets wholly within said third angular interval is generally equal to said discharge pressure of said roller vane pump stage, the improvement comprising:

means defining a bleed orifice in said inlet side plate substantially smaller than each of said roller pockets and located radially to intercept said successive ones of said roller pockets during rotation of said rotor about said centerline and located circumferentially in a segment of an angular interval subtended by said intermediate ramp characterized by flow communication of said bleed orifice with said successive ones of said roller pockets and simultaneous isolation of said successive ones of said roller pockets from each of said inlet and said discharge ports, and means effecting flow communication between said bleed orifice and a receiver means remote from said inlet port having a prevailing pressure therein substantially equal to said inlet pressure of said roller vane pump stags and operative to accept a variable flow rate from said bleed orifice.

2. The motor vehicle fuel pump recited in claim 1 wherein:

each of said roller pockets includes a closed end having a radius of curvature, and said bleed orifice is located radially on said inlet side plate to intercept succeeding ones of said roller pockets at portions thereof defined by said radius of curvature.

3. In a motor vehicle fuel pump assembly having a tubular shell, an electric motor in said tubular shell including an armature shaft supported on said shell for rotation about a centerline of said shell at speeds varying between a minimum corresponding to a minimum fuel demand and a maximum corresponding to a maximum fuel demand, and a vapor separating pump stage in said tubular shell including a housing, an impeller in a cavity in said housing connected to said armature shaft for rotation as a unit therewith, means on said impeller and on said housing cooperating in defining a regenerative turbine pump chamber around said impeller and a vapor discharge chamber radially inboard of said pump chamber, and means on said housing defining an inlet port to said pump chamber in flow communication with a fuel tank and a discharge port from said pump chamber and said vapor discharge port from said vapor chamber in flow communication with said fuel tank, and a roller vane pump stage in said shell including an inlet side plate in a plane perpendicular to said centerline having an arc-shaped inlet port therein in flow communication with said discharge port of said pump chamber, a discharge side plate in a plane perpendicular to said centerline having an arc-shaped discharge port therein, a rotor between said inlet and said discharge side plates connected to said armature shaft for rotation as a unit therewith and having a plurality of outward opening circumferentially spaced roller pockets therein, a plurality of rollers each disposed in a respective one of said roller pockets, and a cam ring between said inlet and said discharge side plates having a cam edge facing said rotor with an inlet ramp and a discharge ramp and an intermediate ramp in an angular interval subtended between a downstream end of said discharge port and an upstream end of said inlet port, the improvement comprising:

means defining a bleed orifice in said inlet side plate substantially smaller than each of said roller pockets and located radially to intercept succeeding ones of said roller pockets during rotation of said rotor about said centerline and located circumferentially in a segment of an angular interval subtended by said intermediate ramp characterized by flow communication of said bleed orifice with succeeding ones of said roller pockets and simultaneous isolation of such succeeding ones of said roller pockets from each of said arc-shaped inlet and said arc-shaped discharge ports, and means effecting flow communication between said bleed orifice and said vapor chamber of said vapor separating pump stage.

4. The motor vehicle fuel pump recited in claim 3 wherein:

each of said roller pockets includes a closed end having a radius of curvature, and said bleed orifice is located radially on said inlet side plate to intercept succeeding ones of said roller pockets at portions thereof defined by said radius of curvature.

5. The motor vehicle fuel pump recited in claim 4 wherein:

said impeller in said vapor separating pump stage is an open vane regenerative turbine pump impeller.

* * * * *